United States Patent [19]

Arleth et al.

[11] 4,316,566

[45] Feb. 23, 1982

[54] APPARATUS FOR REGISTRATION AND CONTROL FOR A MOVING WEB

[75] Inventors: Norman Arleth, Cincinnati, Ohio; Paul E. Dieterlen, Covington, Ky.

[73] Assignee: R. A. Jones & Co. Inc., Covington, Ky.

[21] Appl. No.: 169,852

[22] Filed: Jul. 17, 1980

[51] Int. Cl.[3] ..... B65H 23/18; B65B 57/16

[52] U.S. Cl. ..... 226/2; 53/51; 226/28; 226/137

[58] Field of Search ..... 226/137, 2, 3, 25, 28, 226/29, 30, 31; 53/51

[56] References Cited

U.S. PATENT DOCUMENTS

| | | | |
|---|---|---|---|
| 3,505,776 | 4/1970 | Cloud | 226/2 X |
| 3,583,128 | 6/1971 | Johnson | 53/51 |
| 3,597,898 | 8/1971 | Cloud | 53/183 |
| 3,713,571 | 1/1973 | Simonton | 226/2 |
| 4,023,327 | 5/1977 | Simmons | 53/51 |
| 4,128,985 | 12/1978 | Simmons | 53/51 |

*Primary Examiner*—Edward J. McCarthy
*Attorney, Agent, or Firm*—Wood, Herron & Evans

[57] ABSTRACT

In apparatus for pouch forming, filling and sealing, a printed web, having registration marks at locations where transverse seals are to be formed in order to form a pouch, is fed through drive rolls; over a plow which forms a longitudinal fold in the web; around a sealing wheel having lands which the web contacts to form transverse pouch-forming seals; around a filler where product is poured into the pouches; past a top sealer and a cutoff where the pouch forming is completed and the individual pouches are severed by knives. A photoelectric scanner scans the registration marks and produces a pulse when each passes the scanner. An electric eye cooperating with a disk driven by the machine determines the position of the sealer lands. A tachometer driven by the machine produces pulses proportional to the speed of the machine. A stepping motor continuously drives the drive rolls. The outputs from the photoelectric scanner, the electric eye and the tachometer are used in association with a microprocessor for controlling the position of the registration marks with respect to the lands so as to form transverse seals on the pouches between the printed matter associated with each pouch.

8 Claims, 7 Drawing Figures

APPARATUS FOR REGISTRATION AND CONTROL FOR A MOVING WEB

This invention relates to registration apparatus and more particularly the invention is directed to registration apparatus for a pouch form, fill, seal machine, the registration apparatus maintaining a web properly positioned on the sealing lands forming a part of the pouching machine.

BACKGROUND OF THE INVENTION

While the registration apparatus of the present invention has applications beyond the handling of a web in a pouch form, fill, seal machine, the invention will be described in relation to such a pouch form, fill, seal machine in order to illustrate the registration problems of that machine prior to the present invention and to illustrate the manner in which the present invention solves those problems. A typical form, fill, seal machine is illustrated in Cloud U.S. Pat. No. 3,597,898. The machine includes a supply roll containing an elongated web. The web is fed through drive rolls which are positively driven and whose speed is variable, as will be described, in order to maintain proper registration of the web. The web has printed matter on its surface and has registration marks between each set of printed matter, the registration marks being placed generally in the area where transverse seals are to be formed in order to form the pouches. The web is passed over a plow which forms a longitudinal fold in the web. Thereafter, the web is passed around a sealer rotatable about a vertical axis and having a plurality of vertical heated lands in order to form transverse seals in the web. The web is retained in engagement with a land for more than 180° of the revolution of the sealer, during which excursion the land forms a seal in the web. It is important that the registration mark, or more particularly, the space between the printed matter on the pouch, be properly aligned with the land so that the seal will be formed precisely centered between the printed matter of adjacent pouches. It was the function of prior registration apparatus, and it is the function of the present invention to maintain such an alignment.

After the vertical seals are formed, the web is fed into a rotary filler where product is poured into the respective pouches and thereafter a top longitudinal seal is formed and the pouches are individually cut from the web.

The prior registration apparatus includes a V-belt drive for the drive rolls, the V-belt passing over a pulley having a variable circumference. An idler roller, driven by an air cylinder, is employed to vary the tension in the V-belt. When the tension is increased, the V-belt runs deeper in the variable circumference pulley and hence the pulley runs faster. Conversely, when tension on the idler is reduced, the V-belt rides out of the variable circumference pulley and the drive is slower.

The air cylinder is provided with stops so as to limit the amount of correction that is imparted. A photoelectric scanner is provided to determine the position of the registration marks. A rotatable disk, driven by the machine, is provided with a hole and an electric eye which cooperates to determine the position of the lands on the vertical sealer.

In normal operation, with the registration mark slightly ahead of the vertical sealer lands and the air cylinder de-activated, the web is driven slightly slower than required for proper engagement with the vertical sealer. In this condition the pulses from the registration marks occur slightly ahead of the pulses from the vertical sealer. As the machine runs, the pulses corresponding to the registration marks occur gradually closer to the pulses from the vertical sealer, as the web drops back due to the slightly slow feed rate. When the pulses coincide, the air cylinder is activated to cause the web drive to increase in speed slightly above the required for proper engagement with the vertical sealer. When the pulses do not coincide, the air cylinder is de-activated and the web, being driven slightly slower than the sealer, again drifts backward until coincidence once again is realized.

Provision is made for two corrections by the machine operator. The first correction, made by manipulating knobs on the machine, turns a screw driving the air cylinder in one direction or the other to substantially increase or decrease the drive of the web. This adjustment could be made while the machine is running. The other adjustment, made when the machine is shut down, is to adjust the stops on the air cylinder so as to vary the incremental change imparted by the activation of the air cylinder.

This registration system as described above has had several disadvantages whose ultimate result was the production of scrap and machine down time which reduced the product being packaged on the machine in a given period of time.

Among the disadvantages is the fact that the system requires frequent adjustment on the part of the operator which is reasonably satisfactory if the operator is skilled, but if not, much scrap and down time results. The V-belt system is too crude and lacking in precision. The V-belt itself is spliced, and that has a tendency to make it run irregularly. Further, where a splice occurs in the web, thus putting the registration marks immediately out of alignment, too many pouches have to be run in order to bring the system back into alignment. This latter disadvantage arises in part out of the fact that the correction is uni-directional and active over only a small portion of the cycle. Therefore, a mark placed out of the active range must drift slowly backwards until it returns to the "in-register" position.

Finally, there is a limitation on the amount of correction, the limitation being imposed by the stops on the air cylinder.

BRIEF SUMMARY OF THE INVENTION

An objective of the present invention has been to provide improved apparatus for registering a web to a sealing wheel. The objective of the invention is achieved in part by providing three modes of operation: a first mode for start-up, a second mode when the registration marks are badly out-of-register, and a third mode when the web is substantially in-register with the vertical sealer.

The objective of the invention is more specifically achieved by providing a continuously operating stepping motor drive for the feed rolls and to pulse that stepping motor either by a tachometer which is driven by the machine and timed to the sealing wheel, or from an electric eye which cooperates with a disk driven by the machine and timed to the sealing wheel. A microprocessor is used in association with the signals from the electric eye, the scanner and the tachometer to coordinate the three modes of operation, as will be described below.

During start-up, as the machine is coming up to speed, registration corrections are not made. The stepping motor follows the speed of the machine as indicated by the tachometer, and the registration stays nearly constant wherever the speed of the machine happens to be.

When the machine is up to constant speed, and gross misalignment of the web registration marks with respect to the sealing lands occurs, the microprocessor determines the position of the web and which direction it should be moved to bring it into register in the shortest distance. Then the web is advanced or retarded at a constant rate toward the "in-register" position. The correction rate is made in very small increments so as to avoid large tension changes in the web and to avoid causing the vertical seals to become too wide due to sliding on the sealer. If the seals become too wide, the pouches do not fill properly and machine shutdown occurs.

When the web is substantially "in-register," a third mode of operation takes over to keep the web "locked in." This mode responds to small errors in the position of the web registration marks with respect to the sealing lands and makes quick but large corrections to restore registration before any substantial error can develop. The correction rate depends on the amount of error and gets larger as the web is further out of register.

Each pouch is monitored and the registration system operates constantly in order to maintain a "locked in" relationship.

The several features of the invention will become more readily apparent from the following detailed description taken in conjunction with the accompanying drawings in which.

Figure 1:
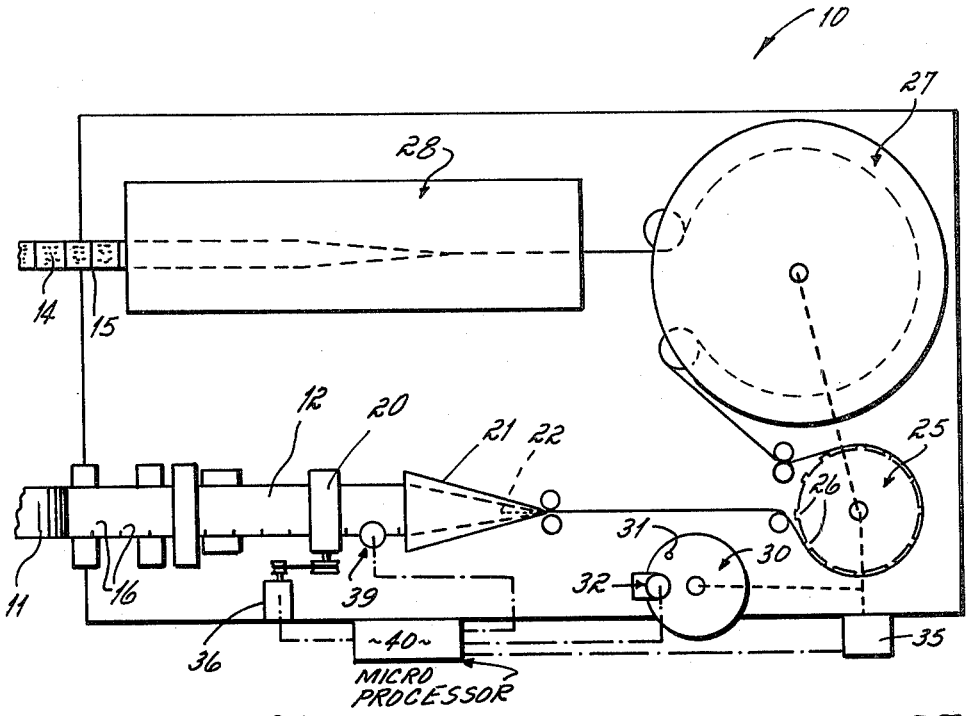
FIG. 1 is a diagrammatic plan view of the apparatus of the invention.
Figure 2:
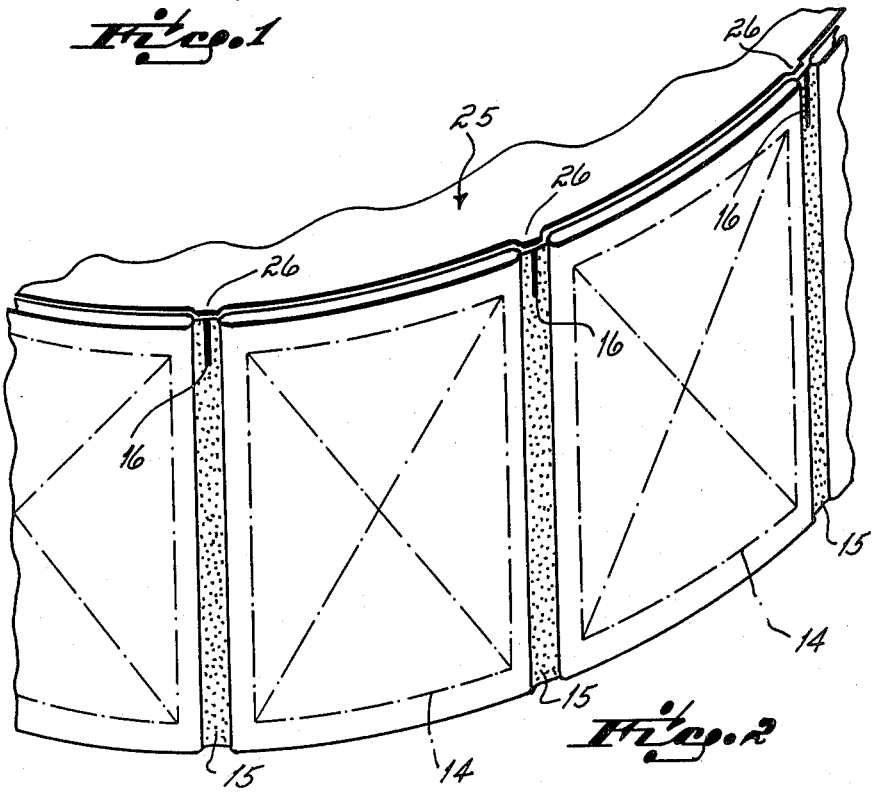
FIG. 2 is a fragmentary perspective view illustrating the engagement of the web with the lands of the vertical sealer.

A pouch form, fill, seal machine is shown at 10 in FIG. 1. The machine includes a supply roll 11 containing a printed web 12. A portion of the web is shown in FIG. 2 and consists of printed matter 14 which is to be associated with each pouch. A sealing area 15 is provided between the printed matter 14 of adjacent pouches and a registration mark 16 is preferably located in the sealing area. It should be noted that the registration mark could be applied elsewhere with suitable adjustment of the apparatus, but as a matter of convenience, it is placed on the sealing area of the web so that the operator can visually observe the registration mark in alignment with the lands of the sealing wheel during the operation of the invention.

The web is fed through drive rolls 20 and over a plow 21 at which a longitudinal fold line 22 is formed, thereby folding the web upon itself. The thus folded web is passed around a vertical sealer 25 having a plurality of heated lands 26. The vertical sealer forms transverse seals in alignment with the registration marks, thus defining individual pouches.

The web is then fed around a filler wheel 27 where pouches are opened and where known apparatus pours measured amounts of product into each pouch. Downstream of the filler wheel, the web is passed through a top sealer 28 which forms a longitudinal seal which closes off the individual pouches. Thereafter, the web is passed through cutting knives where the individual pouches are severed from the web for further handling.

A disk 30, having one or more holes 31 in it, is passed between an electric eye assembly 32 in order to generate a one pulse for each pouch passing around the vertical sealer. In some high speed cases one signal per several pouches may be used, although it is preferred to use one signal per pouch to best keep the pouches in synchronism. The disk is timed to the vertical sealer so as to produce such a pulse as each land on the sealer appears at a predescribed position.

A tachometer 35 is driven by the machine and thus timed to the sealer. The tachometer puts out pulses at a rate which is proportional to the speed of the machine.

A stepping motor 36 is connected to the drive rolls 20 to rotate them and thus determine the linear speed with which the web passes into the machine toward the vertical sealer. Variations in the speed of the stepping motor will determine whether the web advances or retards with respect to the vertical sealer.

The output of the tachometer and the input to the stepping motor are preferably coordinated by a variable speed drive so that the tachometer produces 164 pulses per pouch or machine cycle in the embodiment of the invention which is described herein. It is of course recognized that other forms for timing the tachometer to the stepping motor may be employed without departing from the scope of the present invention.

A photoelectric scanner 39 is provided to scan the registration marks on the web and to produce a pulse as each registration mark passes the scanner.

A microprocessor 40 is provided and programmed to coordinate the signals from the electric eye 32, the tachometer 35 and the scanner 39 in order to vary the speed of the stepping motor and maintain proper registration.

For the purpose of the further description, the pulse from the scanner 39 will be designated A, the pulse from the electric eye 32, indicative of the land position, will be designated B, and the pulses from the tachometer 35 will be designated C.

THE OPERATION IN GENERAL

The registration and control of the present invention has three basic modes of operation. The first is a "start-up" mode. The second is an "in-register" mode and the third is an "out-of-register" mode.

At start-up, the stepping motor for the drive rolls is operated by pulses from the tachometer. The tachometer, as described above, is connected directly to the machine so that the frequency of its output pulses is directly proportional to the speed of the machine. Those pulses are fed to the stepping motor for the drive rolls so that as the machine speed gradually increases, the speed of the drive rolls will gradually increase in time with the machine.

During start-up, it is preferable that the operator thread the web through the machine so that the registration marks, coinciding with the sealing areas, are placed on the lands. The machine can start up with the registration marks completely out of alignment with the lands. The only problem arising out of such start-up would be that the seals may occur through the printed matter rather than in the spaces between printed matter on adjacent pouches. The important aspect of the start-up is that the web be fed in timed relation to the machine so that it does not buckle or tear and so that pouches can be formed and filled without shutdown of the machine.

As a practical matter, the start-up of the machine, or more specifically, getting the machine up to speed, takes place in the span of filling approximately ten pouches. Therefore, if there is a slight problem of the printed matter being out of register with the lands, the only disadvantage would be the loss of a few pouches. Therefore, the fact that registration corrections are not made during start-up results in the loss of only a few pouches more than the prior system in which corrections were started immediately.

The machine running speed of, for example 500 pouches per minute, has been previously set and remains undisturbed. The control system does not actually detect the fact that the machine has gotten up to speed, but rather the control system is based on the fact that machine speed will be achieved before ten pouches have passed around the sealer. Therefore, the count is made of the passage of ten pouches and the microprocessor takes over on the assumption now that the machine is up to speed.

Once the machine is up to speed, or more particularly, the counting of ten pouches or whatever number the system is programmed for has occurred, the tachometer control for the stepping motor is discontinued.

The first phase of the control, immediately following start-up, is to shift into the "out-of-register" mode, there being an assumption that in all probability the registration marks on the pouches will be slightly out-of-register, or perhaps a good deal out-of-register with the lands. If the control system determines that there is precise registration of the registration marks with the lands, the system will immediately shift into the "in-register" mode.

For the purpose of this description, let it be assumed that the registration marks are substantially out of register with the lands and the control system will remain in the "out-of-register" mode. In this mode, the control system operates generally as follows.

The microprocessor monitors the land pulse B first. The B pulse triggers the counting, and the microprocessor counts the tachometer pulses C until the registration pulse occurs and then counting stops. The number of tachometer pulses counted will be in direct proportion to the distance that the registration marks are out of line with the lands.

If it is assumed that the distance between pouches is 328 tachometer pulses, then if the lands are 180° out of phase with registration marks, the counter will count 164 pulses.

If the count is 163, the microprocessor will know that the registration mark is lagging behind the land and correct the speed of the stepping motor to speed up the pouches by a fixed increment. On the other hand, if the count is 165, the microprocessor will know that the registration mark is leading the land and the quickest way to make the correction would be to slow down the feed of the web. In this situation, the pulses to the stepping motor would be reduced.

At normal operating speed, the stepping motor is driven at about 1,000 pulses per second. If it is assumed that the stepping motor will be slowed down to make the correction, the microprocessor will change the pulsing of the stepping motor by 1 pulse or a fraction thereof. Assuming a 1 pulse change, the stepping motor will thereafter be pulsed at 999 pulses per second.

If the registration is 180° out of phase, approximately 500 pouches will have to pass around the sealer before a complete correction is made. At full speed, this will occur in about one minute of operation which is a negligible amount concerning a whole day's production.

By making the change in the distance between the registration mark and the lands in such small increments, there will be no perceptible slipping of the web with respect to the seals, and as far as the filler portion of the pouch machine is concerned, it will see perfectly formed pouches and there will be no interruption of the operation of the machine until the machine is brought into register.

During the change in the registration, the microprocessor will continuously monitor, with every other pouch, the distance between the land and the registration mark. If the microprocessor determines that there is a shortening of the distance by at least one tachometer pulse, then the microprocessor will be satisfied that registration is moving in the right direction.

If the microprocessor determines that correction is not proceeding properly, that is to say, the count on the next succeeding pouch is greater than that caused by the preceding pouch, the microprocessor will stay in the same mode but subtract one more pulse or fraction thereof to the stepping motor. Thus, in the example set forth above, the stepping motor will be pulsed at 998 pulses per second. In this way, the microprocessor continuously monitors the distance between the lands and the registration marks and at every other pouch, if necessary, a correction will be made; but on the other hand, if the misalignment is being corrected at the desired rate (one tach pulse per pouch), no change in the pulsing of the stepping motor will be made.

Correction will proceed as described until a preset number of tach pulses is counted indicating that there is substantial alignment between the registration marks and the lands. When the microprocessor detects this condition, the microprocessor immediately shifts into the "in-register" mode.

It has been determined by observation that the "out-of-register" mode of correction just described does not satisfactorily maintain the register during normal operation when there is substantial alignment between the registration marks and the lands. The reason is not completely known. Such factors as the stretch of the web material, its slippage with respect to the drive rolls and other machine parts may contribute. It has been observed that when trying to maintain registration using the correction system just described, the registration marks tend to wander with respect to the lands and wander out of registration beyond acceptable limits. For this reason, the invention contemplates, in its preferred form, the "in-register" mode to be described as follows.

The microprocessor will monitor the distance between the A and B pulses (web and land) at every other pouch. If there is a misalignment within a preselected limit of tachometer pulses, the microprocessor will correct the stepping motor pulses by an amount sufficient to return the web to perfect alignment with the lands. On the next pouch, however, a new correction to the stepping motor will be made, the new correction being slightly less than the first correction made. Thus, the total correction will be made over two pouches, the first correction being a large correction and the second correction being a backing-off of the large correction so that overall a small correction of the stepping motor drive will be made.

After the second correction, the distance between the A and B pulses will again be monitored (this occurring at now the third pouch), and the two step correction will again be made to the pulsing of the stepping motor. If the web is moving toward alignment, this correction will be slightly less than the preceding correction. That is to say, the large correction will be slightly less than the large correction originally made and the backing-off correction will be slightly less than the backing-off correction originally made. In this fashion, correction will progressively be made until there is exact alignment between the registration marks and the lands.

The registration and control system will proceed in the "in-register" mode as described above with the distance between the A and B pulses being continuously monitored.

At some times during operation of the machine, the distance between the A and B pulses will exceed a preselected amount indicating that there is a substantial misalignment which is best corrected by the "out-of-register" mode rather than the "in-register" mode. At this point, it should be noted that the "in-register" mode of correcting a substantial misalignment is unacceptable because of the large first correction to the misalignment which is made. That large a correction occurring when there is large misalignment causes the web to slip with respect to the sealer to such an extent that a wide banded seal is formed on the pouch and it cannot be filled properly and would thus result in a machine shutdown.

Upon the detection of a substantial misalignment which requires the "out-of-register" mode, the program in the microprocessor jumps back to the start of the "out-of-register" mode which was described above, that point being the start-up of the machine where the stepping motor is driven off the tachometer pulses which are fed to it through the microprocessor. The correction proceeds as described above from that start-up condition.

The number of tach pulses between land and registration mark are counted at every other pouch, and correction is made during the interval that the alternate pouch passes.

DETAILED DESCRIPTION OF THE REGISTRATION AND CONTROL SYSTEM

In the foregoing description, a general description of the approach to attaining and thereafter maintaining registration of the web to the lands has been set forth. The following will be a more detailed description of the manner in which the microprocessor is programmed in order to accomplish the three modes of attaining and maintaining registration described above. The actual programming of the microprocessor, based on the following description, will be well within the skill of the art.

THE START-UP MODE

Figure 3A:
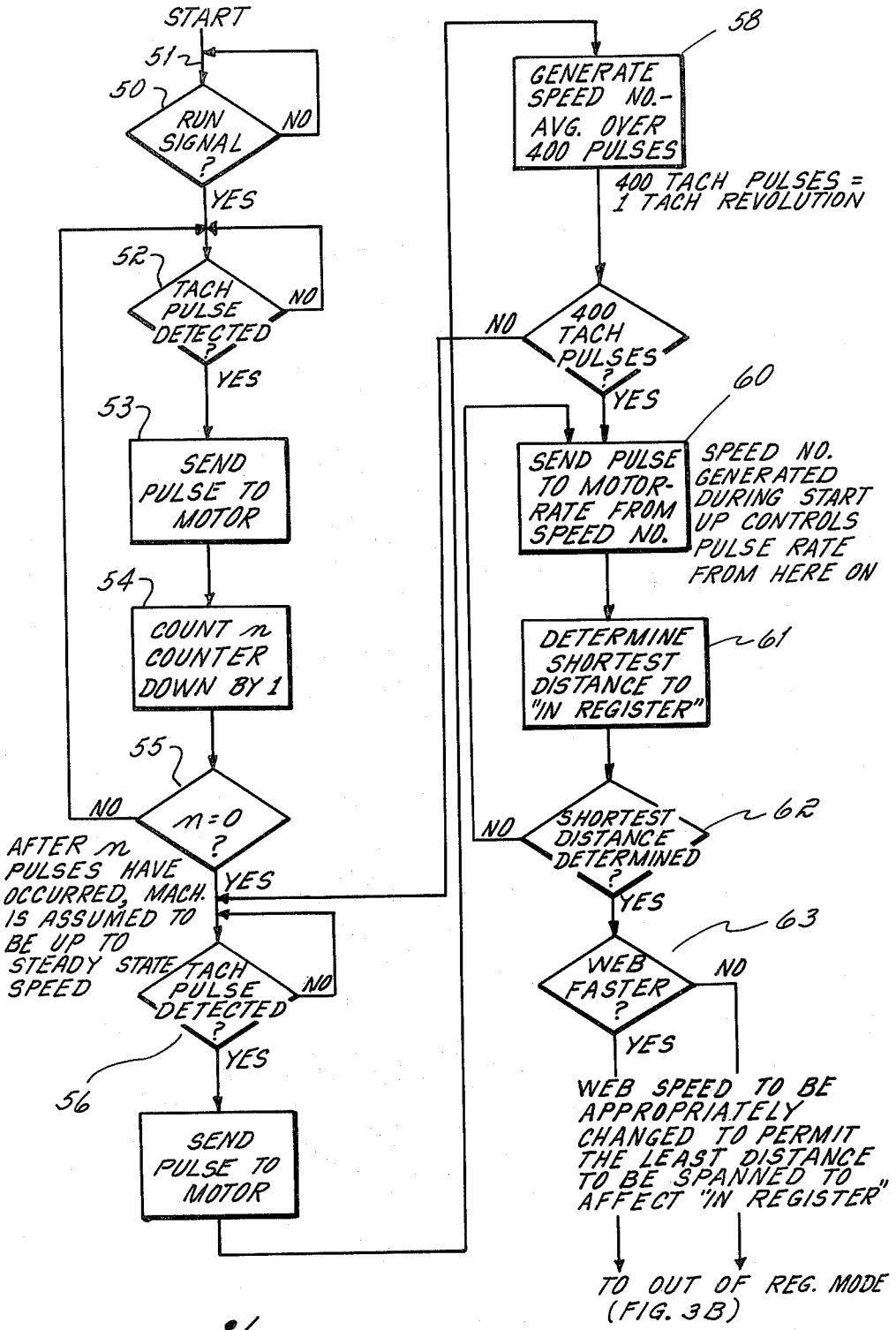
FIGS. 3A to 3E consist of a flow chart of the microprocessor program.

Referring to FIG. 3A which is a flow chart of the start mode, decision block 50 (run signal) continuously looks for a start signal at input 51. The start signal is a steady signal which is caused when the operator closes the switch to start the machine. The block 50 is continuously looping until the start signal appears at 51. When the start signal appears, the decision block 50 permits the program to proceed. Decision block 52 then looks for a tach pulse. When the tach pulse is detected, the program proceeds to action block 53 and sends a pulse to the stepping motor. Immediately the program steps to action block 54 which is a countdown counter having a preselected number, and the counter counts down by one pulse. The number of pulses preset in the action block 54 is equal to the approximately ten pouches which the machine is programmed to run before shifting to the "out-of-register" mode as described above. Action block 54 will continue to count down until it has counted to zero. When the count of zero is detected by decision block 55, this portion of the program will stop looping and proceed to decision block 56. The section just described will continue to loop until there is a countdown to zero detected at decision block 55. In this portion of the program, the stepping motor will be continuously pulsed in direct relation to the C pulses fed to it from the tachometer. At this point in the program, the machine is up to speed. The remaining portion of the program as described in FIG. 3A is the transition into the "out-of-register" program and is a one time only portion of the program occurring over about two pouches.

THE COUNTDOWN COUNTER

At this stage it should be explained that the microprocessor is programmed to effectively provide a countdown counter which, in the embodiment being discussed, counts down one every five microseconds. In the present embodiment, the interval of time between tachometer pulses is approximately one millisecond (0.001). In this interval, the counter will make approximately 200 counts. After the counter counts down to zero, it will cause a pulse to be applied to the stepping motor. In the program to be described hereafter, the time between pulses to the stepping motor, which will increase or decrease its speed, will be varied by changing the number of counts which are required to count down to zero on the counter. For example, if at operating speed the number of counts is 200 and it is desired to slow the stepping motor down, that number will be increased so that there is a longer interval between stepping motor pulses. Hereafter that number will be referred to as the "speed number."

As the pulse is sent to the stepping motor, the action block 58 operates to generate the speed number which will be used hereafter to control the stepping motor.

The action block 58 is counting tach pulses. When it counts down to zero (programmed to count down 400 tach pulses corresponding to one tachometer revolution), it will permit the program to proceed. During this interval, the speed number is being generated by the speed number generator in another section of the microprocessor.

The microprocessor now has a speed number which it will use hereinafter. The speed number will not be regenerated but will be varied depending upon the conditions hereinafter described.

At this point on, the stepping motor will no longer run off the tachometer, but rather will run off of pulses generated by the microprocessor, or more particularly, the speed number which was generated as discussed above. Action block 60 sends pulses to the stepping motor at a rate dependent upon the speed number. Action block 61 looks at the A and B pulses and determines the shortest distance to "in-register," that is, it determines whether to speed up the drive rolls or to decrease the speed of the drive rolls in order to bring the registration marks into register with the lands.

The action block 61 counts tach pulses between the A and B pulse, then counts tach pulses between the B and A pulse, and then compares the number of pulses to determine whether the registration mark is slightly lagging the land or slightly ahead of the land. That determination will decide whether the program should proceed on a speed increase or a speed decrease basis. Decision block 62 keeps this portion of the program looping until the shortest distance has been determined. Decision block 63 tells the program whether there should be a speed increase or a speed decrease. If decision block 63 determines that the speed of the stepping motor should be increased, the program will proceed down the "yes" leg. If the decision block determines that the speed should be decreased, the program proceeds down the "no" leg.

"OUT-OF-REGISTRATION" MODE

Figure 3B:
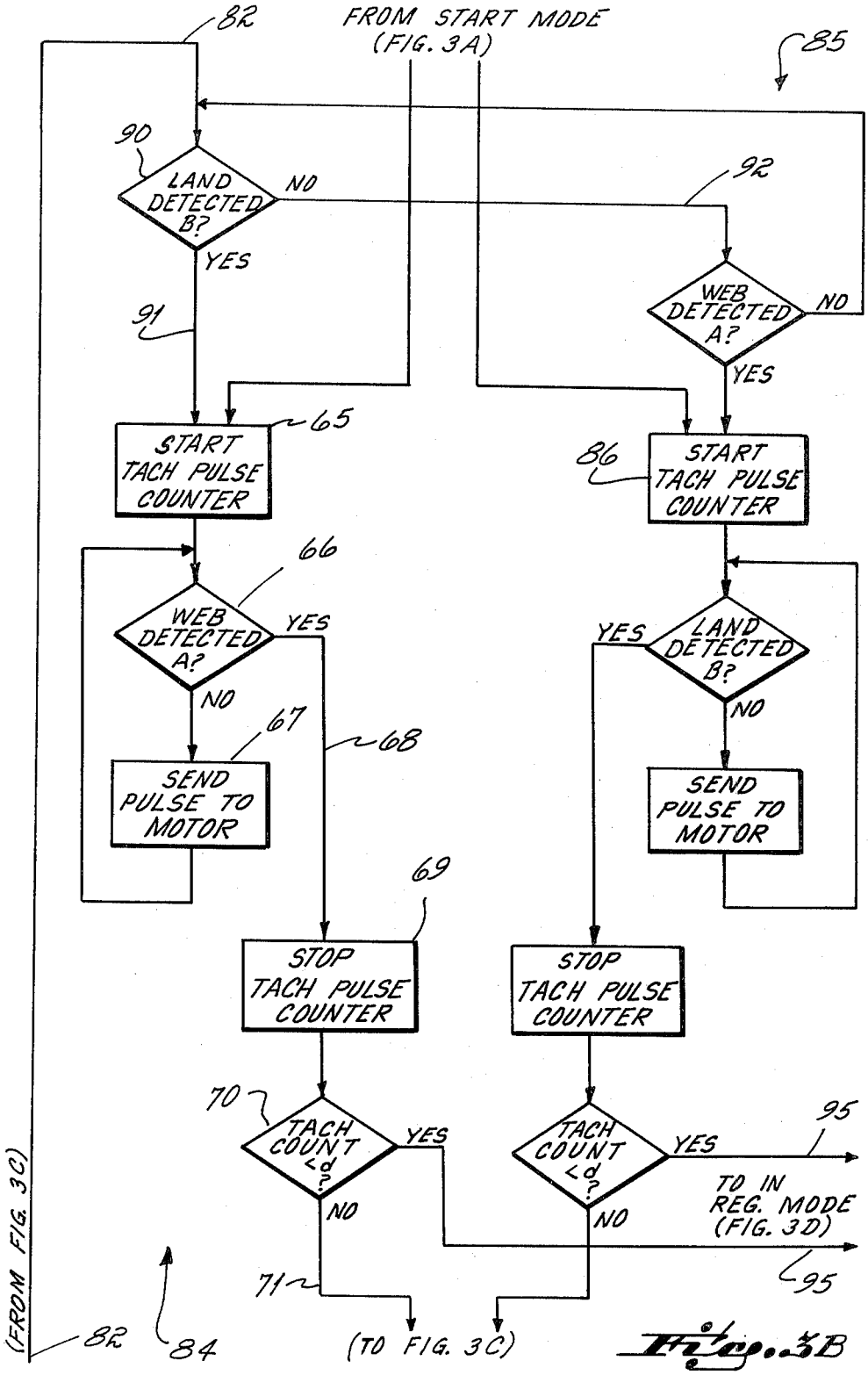
Figure 3C:
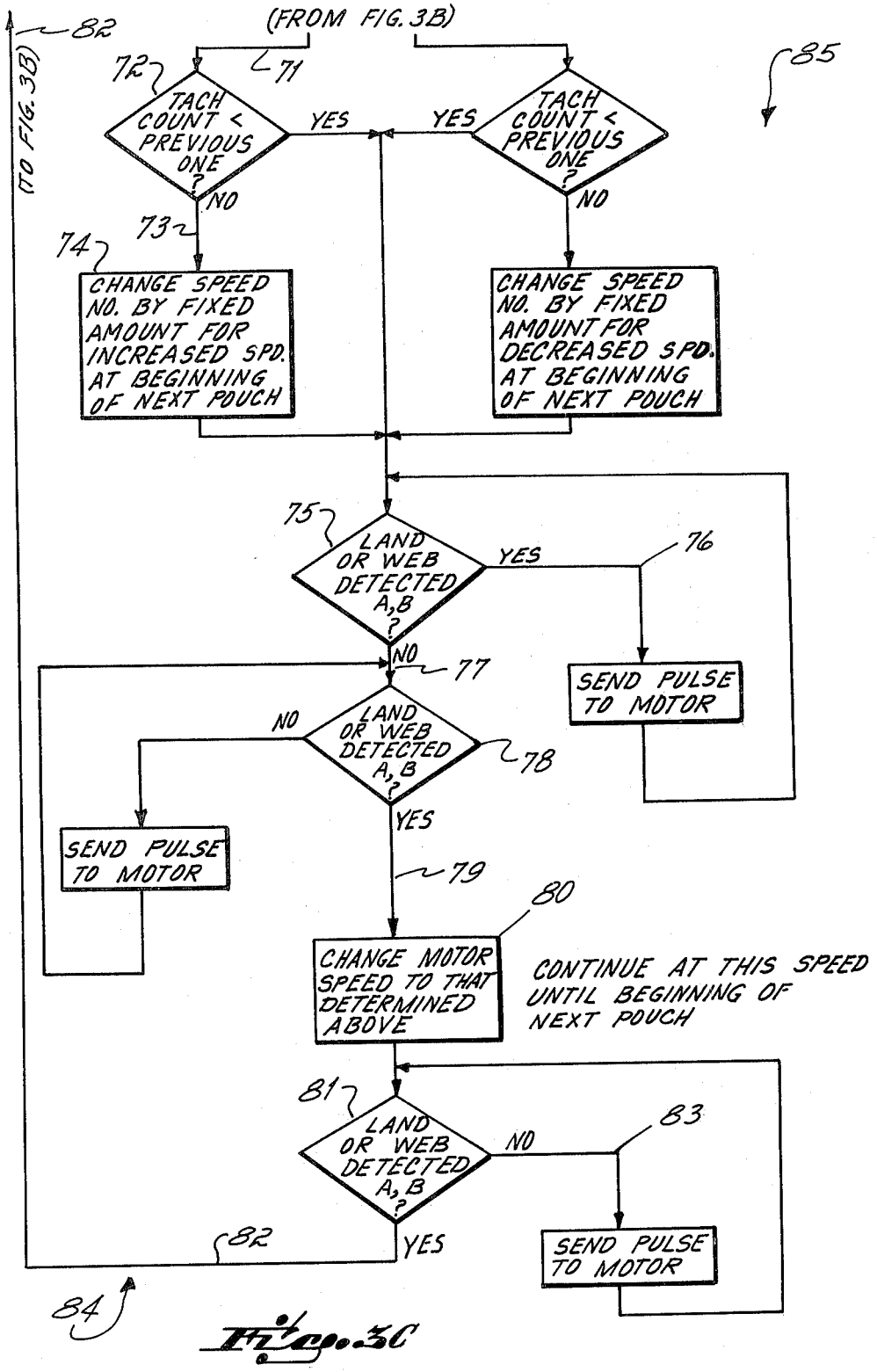

FIGS. 3B and 3C comprise a flow chart of the program for the "out-of-register" mode.

The machine is provided with a tach pulse counter, separate from the microprocessor, which simply receives pulses from the tachometer and counts them. The tach pulse counter will be enabled by the A or B pulse, whichever appears first, and will be disabled by the succeeding B or A pulse, respectively. When disabled, it will hold the number of pulses counted for subsequent use by the microprocessor.

At action block 65, the tach pulse counter is enabled.

Decision block 66 looks for an A pulse from the web, meanwhile continuing to send pulses to the stepping motor via action block 67.

When the pulse A is detected by decision block 66, the program proceeds down the "yes" leg 68 and at action block 69 disables the tach pulse counter.

Decision block 70 has a preset number, for example 6, which is the number of tach pulses forming the dividing line between "in-register" and "out-of-register" operation. The decision block 70 compares the tach pulses counted to the preset tach number in the decision block. If the tach count is less than the prescribed number, the microprocessor will shift to an "in-register" mode. If the tach count is not less than the preset number, the program will proceed along the "no" leg 71, continuing in the "out-of-register" mode.

At this point it should be mentioned that the microprocessor has been programmed to see an artificially high tach count number which is used one time only during start-up.

At decision block 72, the actual tach count is compared to the previous one (in this one instance the artificially high number) to determine whether the tach count is less than the previous one. Because of the artificially high previous tach count, the program is forced into the "no" leg 73.

Because the tach count is low, the stepping motor speed should be increased. Action block 74 causes a change in the speed number to decrease it, thereby shortening the interval between stepping motor pulses. This change will occur at the next upcoming pouch.

Decision block 75 looks for an A pulse. In the procedure being described, an A pulse had been detected at decision block 66. In this procedure, then, the decision block loops through the "yes" leg 76 to continue to pulse the stepping motor. The decision block 75 is also looking for the B pulse. When the A pulse disappears, and no B pulse is present, the procedure shifts to the "no" leg 77.

Decision block 78 is to determine the start of the next cycle. It looks for the next A or B pulse. In the example given, A pulse has just ceased and very likely the next pulse will be the B pulse. During the interval when no pulse is appearing, the decision block 78 continues to loop sending pulses to the stepping motor.

When the B pulse arrives, the program shifts from the "no" loop to the "yes" leg 79. Action block 80 changes the motor speed to that which was determined above. At action block 74 a new speed number was created. At action block 80, that speed number will be applied to the stepping motor and will continuously be applied to the stepping motor until a change in the conditions as described below will alter it by going around through the loop which has just been described above.

Decision block 81 detects the beginning of the cycle, that is to say, it detects the presence of the next A or B pulse (B pulse in this case) and the program proceeds on the "yes" leg 82 to loop back through land detected decision block 90 to the start of the program just described. Until that pulse arrives, the "no" loop 83 continues to pulse the stepping motor but now at the new speed.

The program proceeds in loop 84 (just described) because the decision block 63 (FIG. 3A) determined that the web should be driven faster. If the decision block 63 had determined that the web should be driven slower, then the program would have proceeded through a loop 85 also indicated in FIGS. 3B and 3C with the sequence of operations being the same except that at action block 86 the speed number would have been increased in order to decrease the speed.

At decision block 81, it was determined that A or B pulse had appeared. At decision block 90, a determination is made as to which pulse appeared, A or B. If the B pulse appeared, the program would continue to loop down the "yes" leg 91. If the A pulse had appeared, the program would proceed along "no" leg 92 through the loop 85 for speed decrease.

Regardless of whether the program proceeds in the loop 84 or loop 85, a determination will be made as to whether the correction is proceeding the right direction. In loop 84, if the tach count is less than the previous one, the decision block will cause the program to proceed on the "yes" leg 73 so that as that program continues in the loop 84, the action block 74 which changes the speed number, will be bypassed. Thus, the increment of change in the speed of the stepping motor will remain the same.

The program continues as described until the web registration mark and the land are in substantial alignment. This determination is made by decision blocks 70 in the respective loops 84 or 85. If the tach count is less than the preselected number (6 in the example given), the program proceeds to the "yes" leg 95.

Proceeding on the "yes" leg 95 shifts the program into the "in-register" mode.

"IN-REGISTER" MODE OF OPERATION

Figure 3D:
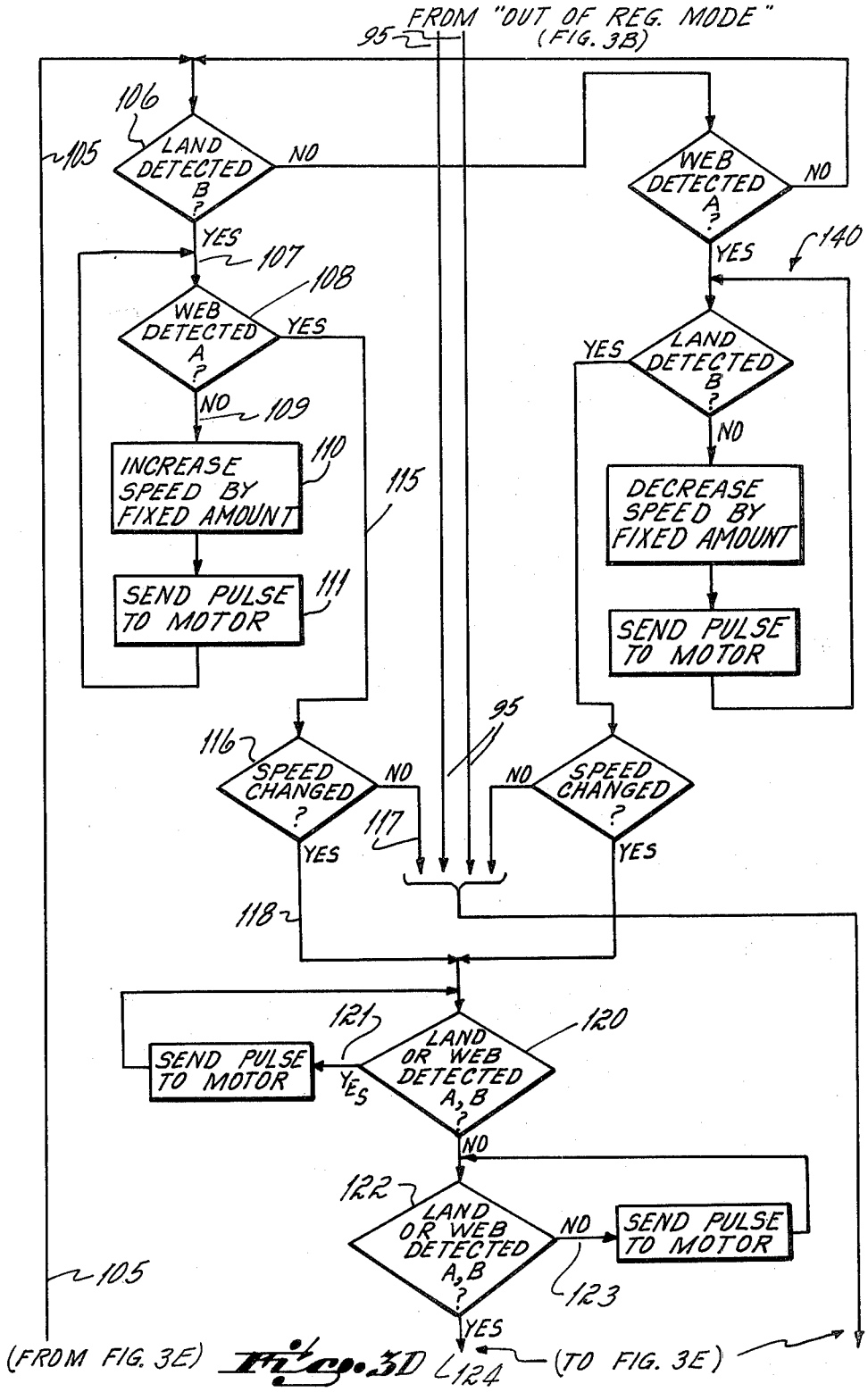
Figure 3E:
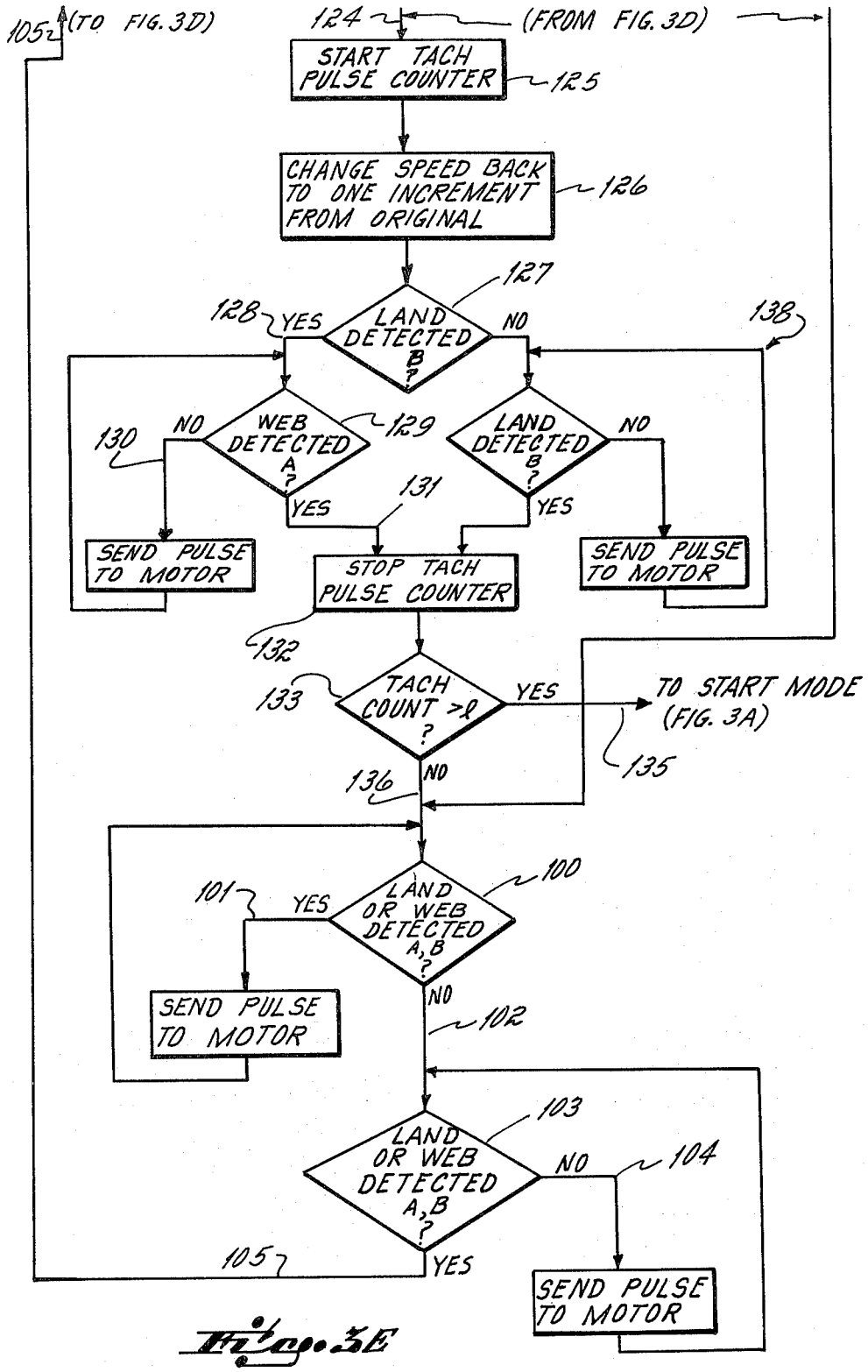

The "in-register" mode is illustrated in FIGS. 3D and 3E.

At the beginning of the "in-register" mode, assurance is provided that the program will begin at the beginning of a cycle, that is, upon the occurrence of either an A or a B pulse. The connecting of leg 95 to decision block 100 (FIG. 3E) provides that assurance. Decision block 100 looks at the leg 95. Decision block 100 determines from legs 95 that an A or a B pulse has occurred. During the occurrence of the A or B pulse, the block 100 continues to loop the program through the loop 101 to pulse the stepping motor.

When there is no pulse, the program proceeds down the "no" leg 102 to the decision block 103. As long as there is no pulse, the decision block loops around loop 104 to continue to pulse the motor.

When an A or B pulse arrives, the decision block shifts the program to leg 105 to decision block 106 (FIG. 3D). Decision block 106 determines whether or not a land (pulse B) has been detected. If a land has been detected, the program proceeds down leg 107. Decision block 108 looks for the registration mark (pulse A). During the interval when no registration pulse A appears, the program will proceed around loop 109 to increase the speed by a fixed amount. The fact that decision block 106 detected B and decision block 108 has not yet detected A indicates that the web is lagging and the speed of the stepping motor must be increased in order to bring the two into registration.

At action block 110, the speed number will be decreased to increase the speed and simultaneously the speed of the stepping motor will be increased. At action block 111, pulses will be continued to the stepping motor. If, after the first pass through the loop, the A pulse has still not been corrected, the speed number and simultaneously the speed of the pulsing motor will be increased by still another fixed increment. These decreases in speed number and increases in speed will continue up to a limit forming part of the program. All of this is occurring within one pouch width. Once the limit is achieved, the program will stay in the loop to continue to send pulses to the stepping motor but without any increase in speed. When the A pulse is detected by decision block 108, the program proceeds along leg 115. At decision block 116, a determination is made as to whether or not there has been a speed change as described above. If it is determined at decision block 116 that there has been no speed change, that determination is tantamount to a determination that the A pulse and B pulse are occurring substantially simultaneously which in turn means that the web is in registration with the lands. Under this condition, the program proceeds on "no" loop 117 which returns the program to the decision block 100. The program then continues around a loop along leg 105 until the web and lands are sufficiently out-of-register to cause a speed change.

When the decision block 116 detects a speed change, the program proceeds along leg 118.

Since the A pulse has been detected in the example being described, decision block 120 has a "yes" loop 121 which continues to pulse the stepping motor during the duration of the A pulse. When the A pulse discontinues, the decision block 122 has a "no" loop 123 which continues to pulse the motor.

The fact that a new pulse is detected at decision block 122 starts a new cycle. When the pulse, A or B, is detected, the program proceeds along "yes" leg 124 to action block 125 which enables the tach pulse counter. At action block 126, the speed number and hence the speed of the stepping motor will be changed back almost to the original speed number so that the new speed number will be the original number with one increment of change. Stated another way, if the loop around decision block 108 had effected three increments of change in the speed number, the decision block 126 would reduce those three increments by two so that the speed number would have been changed by one increment. That new speed will prevail for approximately a pouch interval, that is, until the next A or B pulse (A in the example being described, assuming there was no overcorrection) occurs. Decision block 127 determines which pulse, A or B, was detected.

At this point the function of the program is to determine how far out of the register the web and land are. This will require the counting of tach pulses at the tach pulse counter between the close A and B pulses. If that count is within the prescribed limit, the program will stay in the "in-register" mode. If it is greater than the preselected number, a shift will be made to the "out-of-register" mode.

If the land pulse B is detected, the program proceeds on "yes" leg 128 to decision block 129. Decision block 129 is looking for A pulse. While no A pulse appears, the decision block will operate through loop 130 to continue to pulse the motor. When the A pulse is detected, the program proceeds on "yes" leg 131 to action block 132 to disable the tach pulse counter. At decision block 133, the actual tach count in the intervals between the B and A pulses is compared to the preselected number. If the tach count is greater than the preselected number, the program will proceed on "yes" leg 135, indicating that the web and lands are far out-of-register, requiring re-registration in the "out-of-register" mode. If the tach count is less than the predetermined number, the program proceeds down the "no" leg 136 to the decision block 100 whereupon the loop around the leg 105 is continued.

The leg 135 sends the program back to the start mode so that the program can be utilized to determine whether the registration mark on the web is leading or lagging the land thereby determining which is the shortest direction to proceed to correct the "out-of-register" condition.

The operation around the loop 138 is substantially identical to that just described and occurs if the A pulse is detected at decision block 127.

Furthermore, the program will proceed around the loop 140 in order to decrease the speed in a manner substantially identical to the manner in which the program effects an increase in speed as described above.

At the time of shutdown and the operator manipulates the appropriate switches, or in the case of an automatic shutdown the appropriate switches are manipulated, the program reverts to a tachometer control of the stepping motor so that the stepping motor will be driven at the speed of the tachometer as the pouch machine slows down to a stop. This avoids the snapping of the web in view of the fact that the inertia of the components of the pouching machine is so much greater than the stepping motor that if the two were stopped simultaneously, the stepping motor would stop instantaneously whereas the pouch machine would continue to run through several pouches, thereby snapping the web.

It will be noted that the output from the tachometer 35 and the output from the electric eye assembly 32 which scans the disk 30 are both proportional to machine speed. In the illustrated form, the tachometer produces 164 pulses per cycle and the rotating wheel produces one pulse per cycle. Obviously, the functions of these respective elements could be combined. For example, the tachometer could pulse a counter set to count 164 pulses and create a pulse corresponding to that of the electric eye assembly 32 after each 164 pulses of the tachometer. Such pulses emanating from the counter would be the land pulses B which have been described herein.

The numbers which have been used herein to describe the operation of the machine are only approximate and the invention in no way should be limited to the precise numbers. These numbers will change as the machine speed changes; the numbers would change with a different program in the microprocessor; these numbers would change with a different tachometer and different stepping motor, etc.

Having described our invention, we claim:

1. Apparatus for achieving and maintaining proper registration of a web to a rotating member around which it passes, said web having a plurality of longitudinally spaced registration marks and being driven by a machine which includes the rotating member, said apparatus comprising, drive rolls through which said web passes, a stepping motor connected to said drive rollers to drive said rollers, means for supplying pulses to said stepping motor to continuously rotate said motor, means producing an output of pulses whose frequency is proportional to the speed of the machine, a scanner associated with said web for producing a registration pulse as each registration mark passes said scanner, means generating a land pulse each time a registration mark is to land on said rotating element, means for monitoring the interval of time between the occurrence of said registration mark and land pulses, respectively, and means for varying the frequency of the pulses supplied to said stepping motor to shorten said interval between registration mark and land pulses.

2. In a pouch form, fill, seal machine, apparatus for achieving and maintaining proper registration of a longitudinally folded web to a sealer having circumferentially spaced lands around which said web passes, said web having a plurality of longitudinally spaced registration marks and printed matter between said marks, said web being driven by a machine which includes the sealer, said apparatus comprising, drive rolls through which said web passes, a stepping motor connected to said drive rollers to drive said rollers, means for supplying pulses to said stepping motor to continuously rotate said motor, a tachometer driven by said machine and producing an output of pulses whose frequency is proportional to the speed of the machine, a scanner associated with said web for producing a registration pulse as each registration mark passes said scanner, means generating a land pulse each time a registration mark is to engage a land on said sealer, means for monitoring the interval of time between the occurrence of said registration mark and land pulses, respectively, and means for varying the frequency of the pulses supplied to said stepping motor to shorten said interval between registration mark and land pulses, whereby said registration marks are normally aligned with said sealer lands to assure that the location of pouch forming seals is located between printed matter.

3. Apparatus as in claim 2 further comprising means connected between said tachometer and said stepping motor to drive said stepping motor at a speed directly proportional to said tachometer output from the time said machine is started until said machine attains a predetermined speed.

4. Apparatus as in claim 2 further comprising, means for varying the frequency of said pulses from said supply by a fixed increment if said monitoring means determines that said interval is greater than a preselected amount.

5. Apparatus as in claim 4 in which said fixed increment is very small in relation to the frequency to drive said web the full distance between said registration marks, whereby the reduction in said interval is small as each pouch engages said rotating member.

6. Apparatus as in claim 5 wherein said fixed increment is of an amount to reduce said interval by an amount equal to the time a registration mark moves approximately 1/1000 of a pouch width.

7. Apparatus as in claim 2 further comprising means for varying the frequency of said pulses from said supply by an increment proportional to said interval if said monitoring means determines that said interval is less than a predetermined amount.

8. Apparatus as in claim 7 in which said pulse frequency varying means makes a first change of frequency sufficient to reduce to zero said interval between said land and registration mark pulses, and makes a second, opposite change sufficient to create a similar interval but shorter in time than said initially monitored interval.

* * * * *